US007140907B2

(12) United States Patent
Baldwin, Jr.

(10) Patent No.: US 7,140,907 B2
(45) Date of Patent: Nov. 28, 2006

(54) STRAIN-RELIEVING DEVICE FOR CARD CONNECTED CABLES

(75) Inventor: Richard G. Baldwin, Jr., Austin, TX (US)

(73) Assignee: National Instruments Corporation, Austin, TX (US)

( * ) Notice: Subject to any disclaimer, the term of this patent is extended or adjusted under 35 U.S.C. 154(b) by 0 days.

(21) Appl. No.: 10/936,080

(22) Filed: Sep. 8, 2004

(65) Prior Publication Data

US 2006/0052002 A1 Mar. 9, 2006

(51) Int. Cl.
*H01R 13/58* (2006.01)

(52) U.S. Cl. ..... 439/449; 439/470; 439/296; 439/359

(58) Field of Classification Search ..... 439/449, 439/470, 296, 359
See application file for complete search history.

(56) References Cited

U.S. PATENT DOCUMENTS 3,864,011 A 2/1975 Huber
4,130,334 A 12/1978 Anderson
4,352,531 A 10/1982 Gutter
4,358,177 A * 11/1982 Badolato ..... 439/472
4,448,474 A * 5/1984 Melnychenko ..... 439/472
5,928,023 A * 7/1999 Buckner et al. ..... 439/373
5,980,298 A * 11/1999 Johnson ..... 439/359
6,331,940 B1 * 12/2001 Lin ..... 361/785

OTHER PUBLICATIONS

Assembly, Strain Relief, Motion Control Enclosure Drawing Sheet, Copyright 2001 (1 page).
ExpressCard Standard, Release 1.0, First printing Dec. 2003 (74 pages).

* cited by examiner

*Primary Examiner*—Truc Nguyen
(74) *Attorney, Agent, or Firm*—Meyertons Hood Kivlin Kowert & Goetzel, P.C.; Jeffrey C. Hood; Russell E. Henrichs

(57) ABSTRACT

In some embodiments, a module may have a slot for an input/output card. While cables may be connected to the card in the module, external forces acting on the cable and/or module may result in the cable pulling the card out of the module, damaging the connector or card. In some embodiments, a strain-relieving device may be used to counter these forces on the cable. In some embodiments, a positioning strip may be coupled to a base placed over the card in the module. In some embodiments, a cable grip may be coupled to the positioning strip through a bracket. In some embodiments, the cable grip may include two plates that are coupled to the bracket through fasteners. As the fasteners are tightened, a distance between the two plates may decrease, and a cable between the plates may be at least partially secured between the plates.

23 Claims, 9 Drawing Sheets

STRAIN-RELIEVING DEVICE FOR CARD CONNECTED CABLES

BACKGROUND OF THE INVENTION

1. Field of the Invention

The present invention relates generally to computer hardware and, more specifically, to strain-relieving devices for cables and cable connectors.

2. Description of the Related Art

Instruments for collecting data or information from an environment or unit under test may be coupled to and controlled by computer systems (e.g., through a cable between the instrument and the computer system). Examples of various types of instruments include oscilloscopes, digital multimeters, pressure sensors, etc., and the types of information that might be collected by respective instruments include voltage, resistance, distance, velocity, pressure, frequency of oscillation, humidity or temperature, among others. Data collected by these instruments may be used to control units being tested (e.g., an overheated unit may be shutdown) or an environment (e.g., ventilation systems may be activated if a certain chemical is detected in the air). Data may also be displayed to a user responsible for control and/or may be monitored for experimental purposes (e.g., to better design the unit being tested). Instruments and/or computer systems may also perform various data analysis and data processing on collected data prior to controlling a unit and/or displaying data to the user.

Instrumentation systems may run on a platform such as PXI (Peripheral Component Interconnect (PCI) eXtensions for Instrumentation). PXI may combine a high-speed PCI bus with integrated timing and triggering designed for measurement and automation applications to deliver performance improvements over other architectures. PXI may be built on a modular and scalable CompactPCI specification and the high-speed PCI bus architecture. As a result, PXI products may maintain interoperability with CompactPCI, offering increased mechanical integrity, easier systems integration, and additional expansion slots than desktop computers.

While PXI may offer substantially improvements, it may also pose several challenges. For example, cables used between a PXI module and an external system (e.g., an instrumentation system) may be coupled to the PXI module by an Input/Output (I/O) card in a slot on the PXI module. Various rugged environments may put strain on the cable and, correspondingly, on the I/O card and card connection to the PXI module. This strain may detach the cable from the I/O card and/or detach the I/O card from the PXI module, possibly resulting in a loss of data, loss of time (to reattach the I/O card and cable to the PXI module), and/or damage.

SUMMARY OF THE INVENTION

In some embodiments, a module (e.g., a PXI module) may have a slot for an input/output (I/O) card (e.g., an expresscard, Personal Computer Memory Card International Association (PCMCIA) memory card, etc.). The card may be coupled to an external system (e.g., an instrumentation system) by a cable. External forces acting on the cable and/or module may result in the cable disconnecting from the card and/or dislodging the card from the card connection to the module. This may also damage the module, card, and/or cable. In some embodiments, a strain-relieving device may be used to counter these forces on the module and/or cable to better secure the cable and card to the module.

In some embodiments, a base of the strain-relieving device may fit over a slot on the module to secure the card in the module. In some embodiments, the base may have tabs that correspond to notches on the card (e.g., if the card at least partially sticks out of the module). In some embodiments, a positioning strip (e.g., a single strip positioned to the center of one side of the base) may be coupled to the base. In some embodiments, a cable grip may be coupled to and positioned (relative to the module) by the positioning strip. For example, the cable grip may be coupled to the positioning strip through a bracket. In some embodiments, the cable grip may be connected directly to the positioning strip.

In some embodiments, the cable grip may couple to the bracket through a fastener (e.g., a screw) passing through one or more holes on the bracket and one or more corresponding holes on the cable grip. As used herein, "hole" includes openings such as slots, cavities, and gaps, among others. The bracket may also be coupled to the positioning strip through a fastener through one or more holes on the positioning strip and corresponding holes on the bracket. In some embodiments, a projection on the bracket may fit inside a hole (e.g., a hole above the hole with the fastener) on the positioning strip to prevent rotation of the bracket relative to the positioning strip when the bracket is coupled to the positioning strip.

In some embodiments, the cable grip may include two plates, which are coupled to the bracket or directly to the positioning strip through one or more fasteners. As the one or more fasteners are tightened, a distance between the two plates may decrease. A cable placed between the plates may be at least partially secured between the plates when the fastener is tightened. As used herein, "cable" refers to a cable and any cable coupled to the cable. In some embodiments, foam or some other material may be coupled to the plates to further grip the cable.

BRIEF DESCRIPTION OF THE DRAWINGS

A better understanding of the present invention may be obtained when the following detailed description is considered in conjunction with the following drawings, in which.

Figure 1:
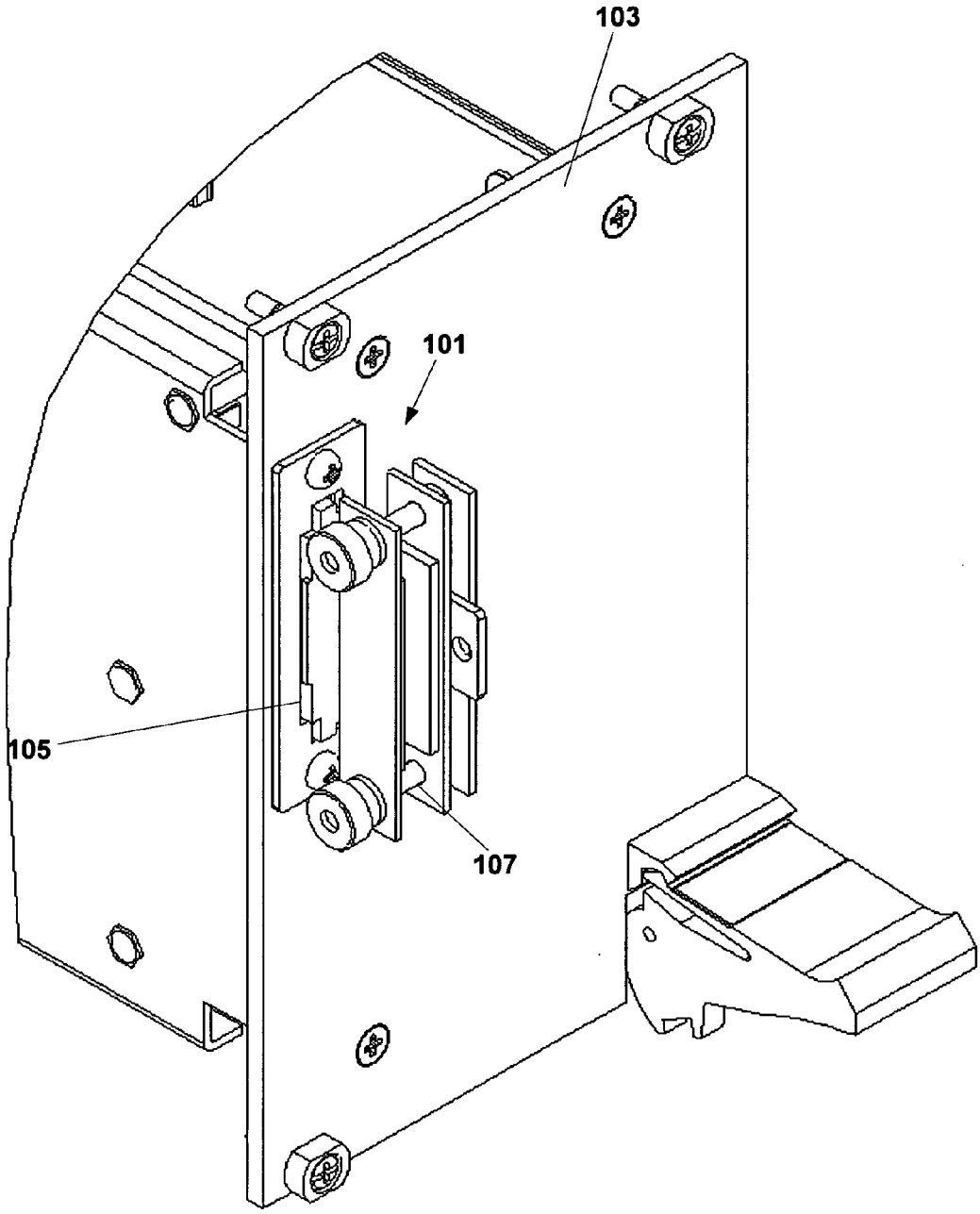
FIG. 1 illustrates a partial view of a module with a strain-relieving device, according to an embodiment.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims. Note, the headings are for organizational purposes only and are not meant to be used to limit or interpret the description or claims. Furthermore, note that the word "may" is used throughout this application in a permissive sense (i.e., having the potential to, being able to), not a mandatory sense (i.e., must). The term "include", and derivations thereof, mean "including, but not limited to". The term "coupled" means "directly or indirectly connected".

DETAILED DESCRIPTION OF THE INVENTION

FIG. 1 illustrates an embodiment of a partial view of a module 103 with a strain-relieving device 101. In some embodiments, a module (e.g., a PXI module 103) may have a slot 105 for an input/output (I/O) card (e.g., an expresscard) that may be coupled to an external system (e.g., an instrumentation system) by a cable (not shown). External forces acting on the cable and/or module 103 may result in the cable disconnecting from the card and/or dislodging the card from the card connection to the module 103. For example, the instrumentation system coupled to the card by the cable may be in motion. If the card is disconnected from the module 103, data may be lost. In addition, time may be wasted as the card may need to be manually reconnected to the module 103 after being disconnected. In some embodiments, a strain-relieving device 101 may be used to counter these forces between the module 103 and the cable. While embodiments described herein illustrate the strain-relieving device 101 that may be used with a module 103, it is to be understood that the strain-relieving device 101 may be used with other devices including computer (e.g., laptops) and other devices that interface with a card.

Figure 2:
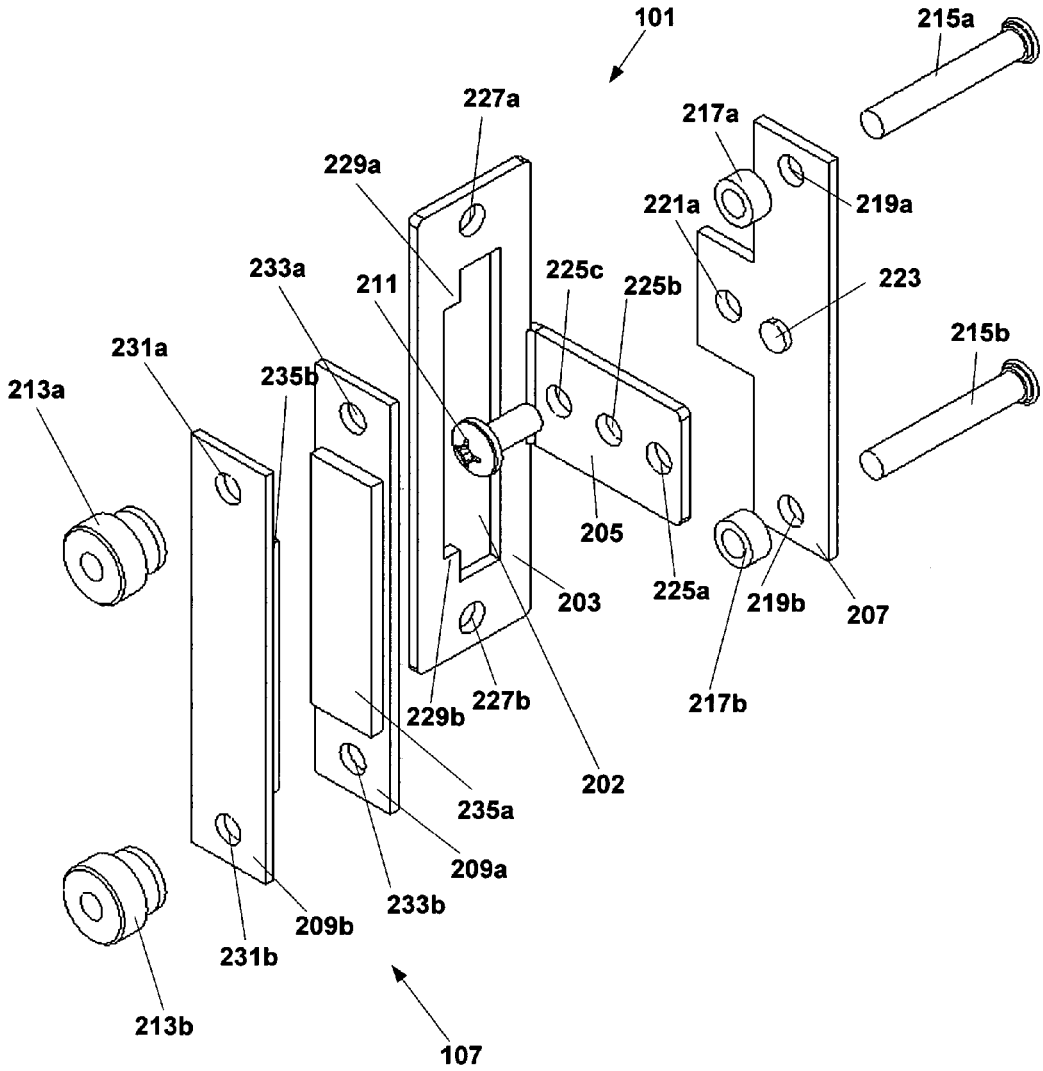
FIG. 2 illustrates an expanded view of a strain-relieving device, according to an embodiment.
Figure 3A:
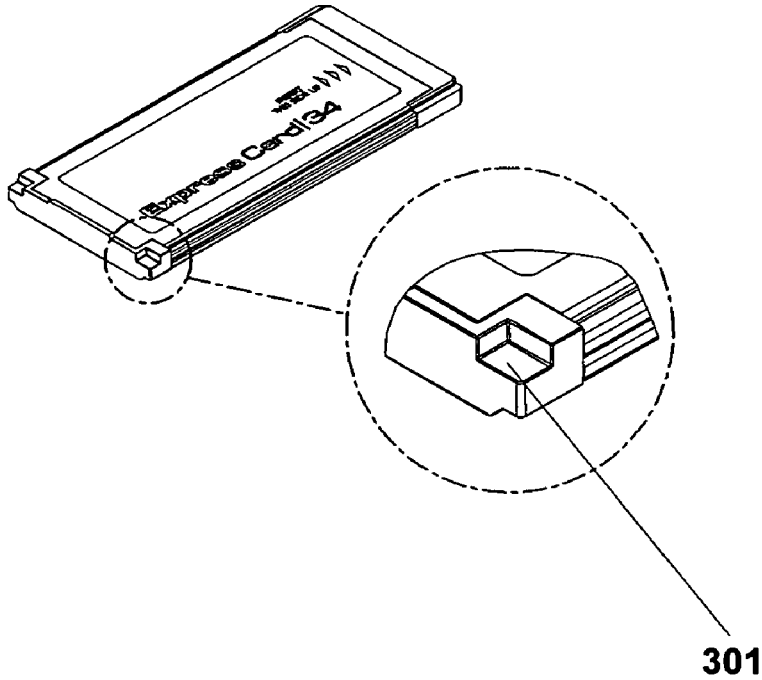
FIGS. 3*a* and 3*b* illustrate notches in expresscards, according to an embodiment.
Figure 3B:
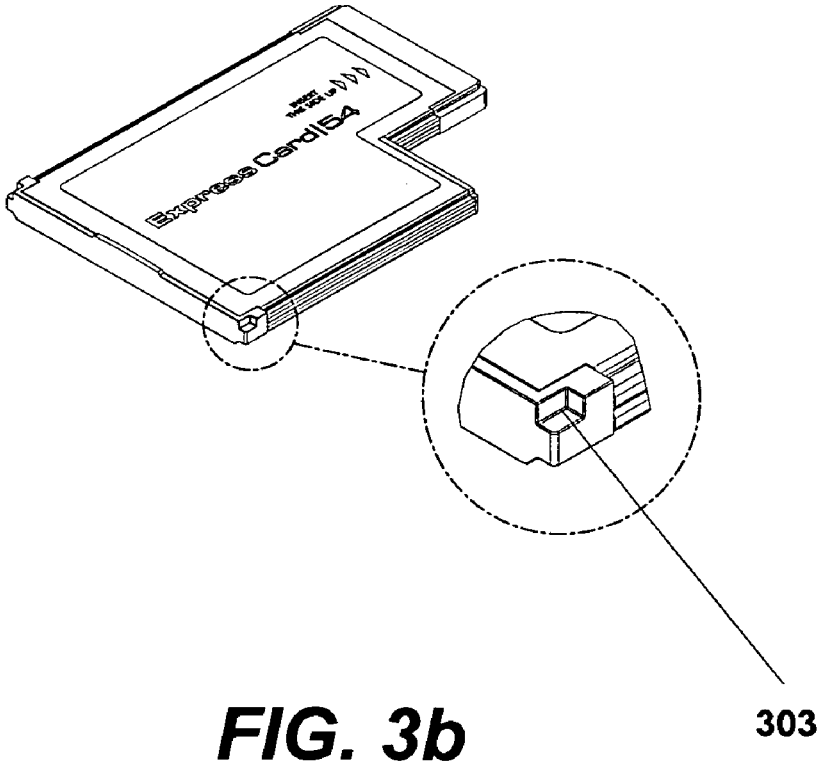

FIG. 2 illustrates an expanded view of the strain-relieving device 101, according to an embodiment. In some embodiments, a base 203 may fit over the slot 105 on the module 103 to secure the card in the module 103. The base 203 may be a flat plate (e.g., made out of sheet metal) with an oblong shaped hole 202. Other configurations for the base 203 are also contemplated. The hole 203 may allow access to a connector on the card when the base 203 is placed over the card. In some embodiments, the base 203 may have tabs 229 that correspond to notches (e.g., notch 301 in FIG. 3*a* and notch 303 in FIG. 3*b*). In some embodiments, if the card at least partially sticks out of the module 103, the tabs 229 may secure the card by aligning with the notches on the card at the point where the card extends out of the module 103. In some embodiments, the tabs 229 may engage a side of the card to prevent the card from extending out of the module 103 (e.g., a flat card surface without notches). In some embodiments, base 203 may be secured to the module 103 with fasteners (e.g., screws) through holes 227 in the base 203. Adhesive (e.g. glue or Velcro™), rivets, or snaps may also be used to couple the base to the module. Other fasteners are also contemplated. In some embodiments, the base 203 may be removable to facilitate card removal and/or exchange. In some embodiments, the base 203 may be rigidly affixed to the module 103 to prevent card removal (e.g., through fasteners that are not intended to be removable). In some embodiments, a side of the base 203 facing the card may have foam or another cushioning material on it to further secure and cushion the card in the module 103.

In some embodiments, a positioning strip 205 may be coupled to the base 203 to position a cable grip 107 relative to the base 203. As shown in FIG. 2, in some embodiments, the positioning strip 205 may be a single strip positioned to the center of one side of the base 203. In some embodiments, the positioning strip 205 may be coupled to the module 103. The positioning strip 205 may include one or more holes 225. In some embodiments, a cable grip 107 may be coupled to the positioning strip 205 through a bracket 207. In some embodiments, the cable grip 107 may be connected directly to the positioning strip 205.

In some embodiments, the cable grip 107 may couple to the bracket 207 through one or more holes 219 on the bracket 207 and corresponding holes (e.g., holes 231 and 233) on the cable grip 107. The bracket 207 may also be coupled to the positioning strip 205 through a fastener (e.g., a screw 211, a bolt/nut, a rivet, etc.) through hole 221*a* and a hole 225 on the positioning strip 205. In some embodiments, the bracket 207 may have a hole 221*a* and a projection 223. The projection 223 on the bracket 207 may fit inside a hole 225 (e.g., a hole above the hole used with the fastener) on the positioning strip 205 to prevent rotation of the bracket 207 relative to the positioning strip 205 when the bracket 207 is coupled to the positioning strip 205. In some embodiments, the projection 223 may be on the positioning strip 205 to fit with a corresponding hole on the bracket 207. Because of the projection 223, the fastener may not be placed in the furthest hole from the base 203, because the projection 223 may need a hole on the positioning strip 205 above the hole engaged by the fastener. In some embodiments, the projection 223 may engage a hole below a hole on the positioning strip 205 engaged by the fastener. As stated earlier, the holes in the positioning strips and/or bracket may be slot shaped. For example, holes 225*b* and 225*c* may be one continuous slot-shaped hole. In some embodiments, hole 221*a* may be slot shaped. In some embodiments, slot shaped holes may allow limited freedom of movement of a component coupled through the hole until the component is restricted by tightening a corresponding fastener.

Figure 4:
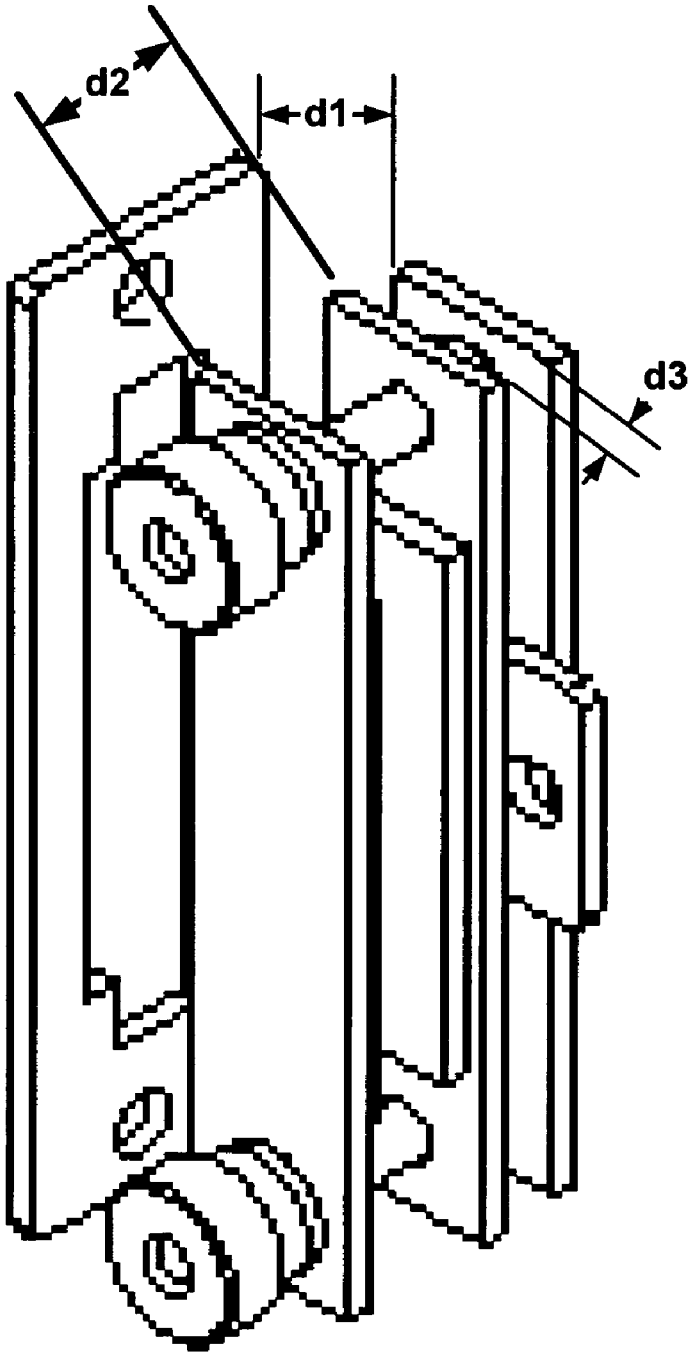
FIG. 4 illustrates a strain-relieving device with a bracket, according to an embodiment.

In some embodiments, a distance d1 (seen in FIG. 4) between the bracket 207 and the base 203 (and correspondingly between the cable grip 107 and the base 203) may correspond to which hole 225 on the positioning strip 205 the hole 221 on the bracket 207 is coupled. For example, the distance d1 between the bracket 207 and the base 203 when fastener 211 couples the bracket 207 to the base 203 through holes 221*a* and 225*c* may be less than the distance between the bracket 207 and the base 203 when the fastener 211 couples the bracket 207 to the base 203 through holes 221*a* and 225*b*.

In some embodiments, the cable grip 107 may include two plates 209 (a first plate 209*a* and a second plate 209*b*) which are coupled to the bracket 207 through fasteners (e.g., an adjustable fastener such as a bolt 215, spacer 217, and nut 213). The fastener may couple the two plates 209 to the bracket 207 through holes 219, 231, and 233. As the fastener is tightened, a distance d2 (seen in FIG. 4) between the two plates 209 may decrease. A cable between the plates may be at least partially secured (i.e., have restricted movement) between the plates. The spacers 217 may be plain spacers, or may be threaded. Other spacer configurations are also contemplated. In some embodiments, the spacers 217 may position plate 209*a* a distance d3 (seen in FIG. 4) from the bracket 207 to approximately center the two plates 209 over the hole 202 in the base 203. In some embodiments, the spacers 217 may not center the two plates 209 over the hole 202 in the base 203. In some embodiments, the spacers 217 may not be used. In some embodiments, foam 235 or some other cushioning material may be coupled to the plates to further grip the cable.

Other configurations for the cable grip may also be used. For example, the cable grip may be a single piece (e.g., an adjustable metal ring) or may be a spring clamp. In some embodiments, the cable grip may be coupled to the cable through adhesive. In some embodiments, the cable grip may have more than two grip plates.

Figure 5:
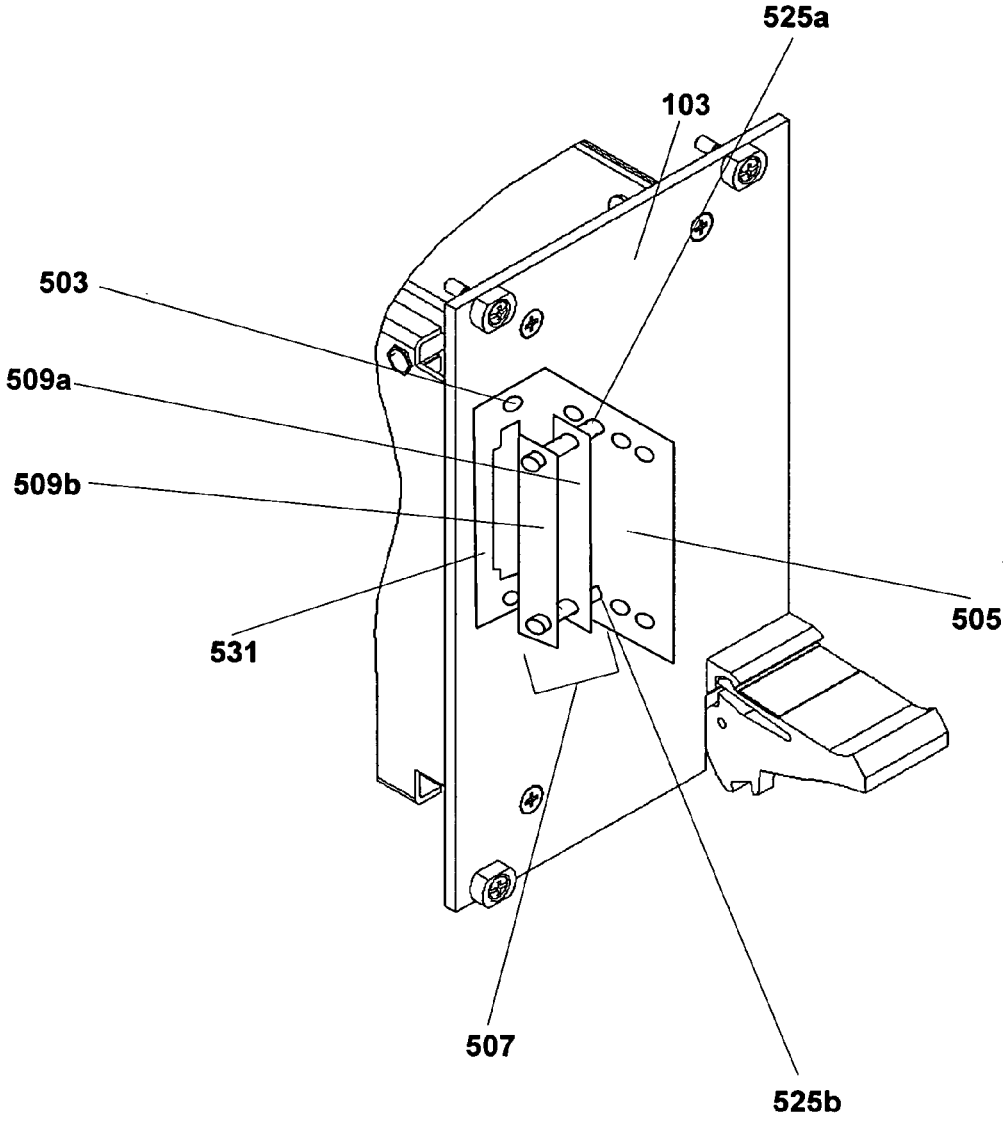
FIG. 5 illustrates a strain-relieving device with a broad positioning strip, according to an embodiment.

Referring to FIG. 5, an embodiment with the cable grip 507 coupled to the positioning strip 505 is shown. In some embodiments, the positioning strip 505 may be coupled to the base 531 (e.g., the positioning strip 505 and the base 531 may be a continuous piece of material). In some embodiments, plates 509 of cable grip 507 may be fastened to positioning strip 505 through multiple holes 525. The cable grip 507 may be coupled to the positioning strip 505 through a hole on each side of each plate 509 and two corresponding holes 525 on the positioning strip 505. Additional holes may also be used for fasteners. The cable grip 507 may be moved up or down the positioning strip 505 by fastening the cable grip 507 to different sets of holes available on the positioning strip 505.

Figure 6:
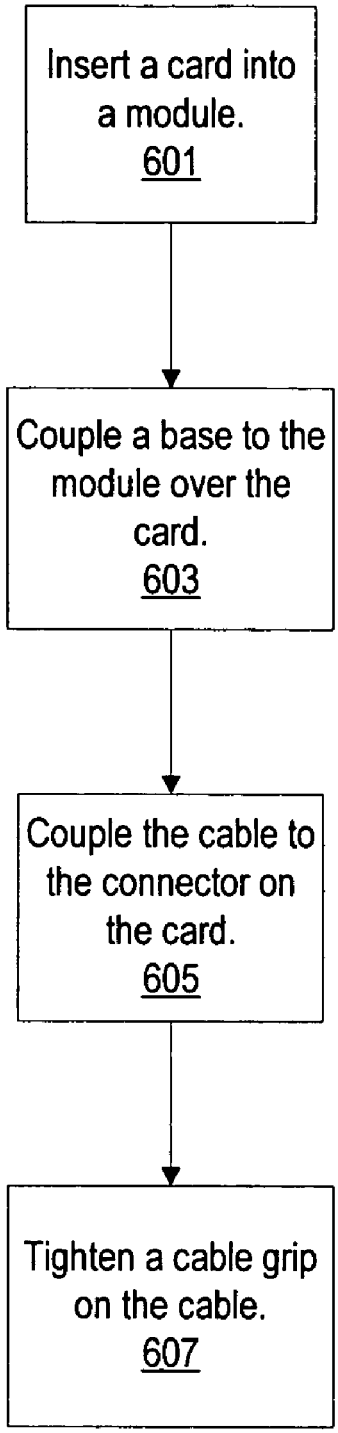
FIG. 6 illustrates a method for providing strain relief to a cable, according to an embodiment.

FIG. 6 illustrates a method for providing strain relief to a cable, according to an embodiment. It should be noted that in various embodiments of the methods described below, one or more of the method elements described may be performed concurrently, in a different order than shown, or may be omitted entirely. Other additional elements may also be performed as desired.

Figure 7A:
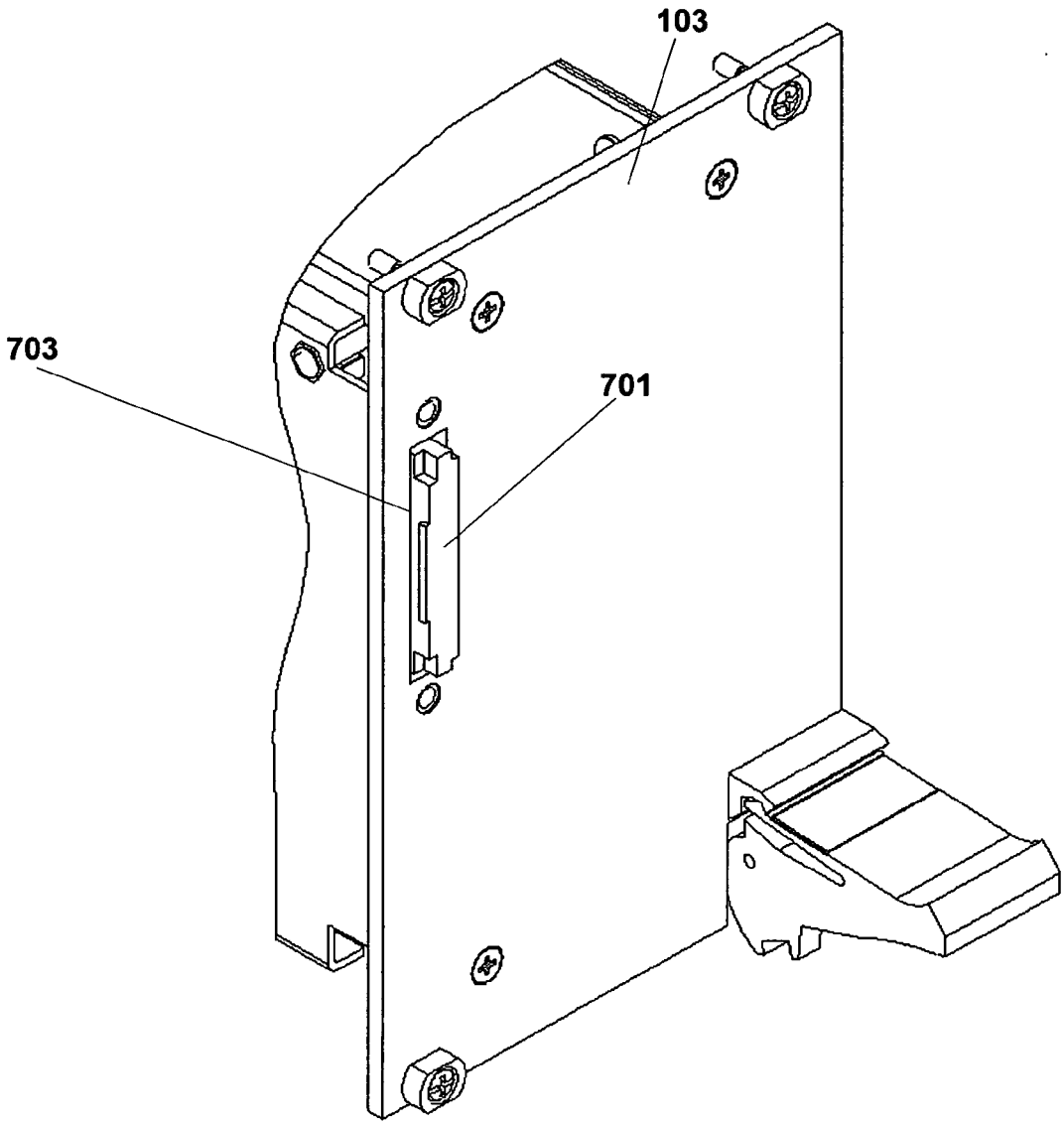
FIGS. 7*a*, 7*b*, and 7*c* illustrate a card and cable being inserted into a strain relieving device, according to an embodiment.

At 601, a card 701 (e.g., an expresscard) may be inserted into a module 103 (seen in FIG. 7*a*). For example, card 701 may be inserted into a slot 703 of module 103.

Figure 7B:
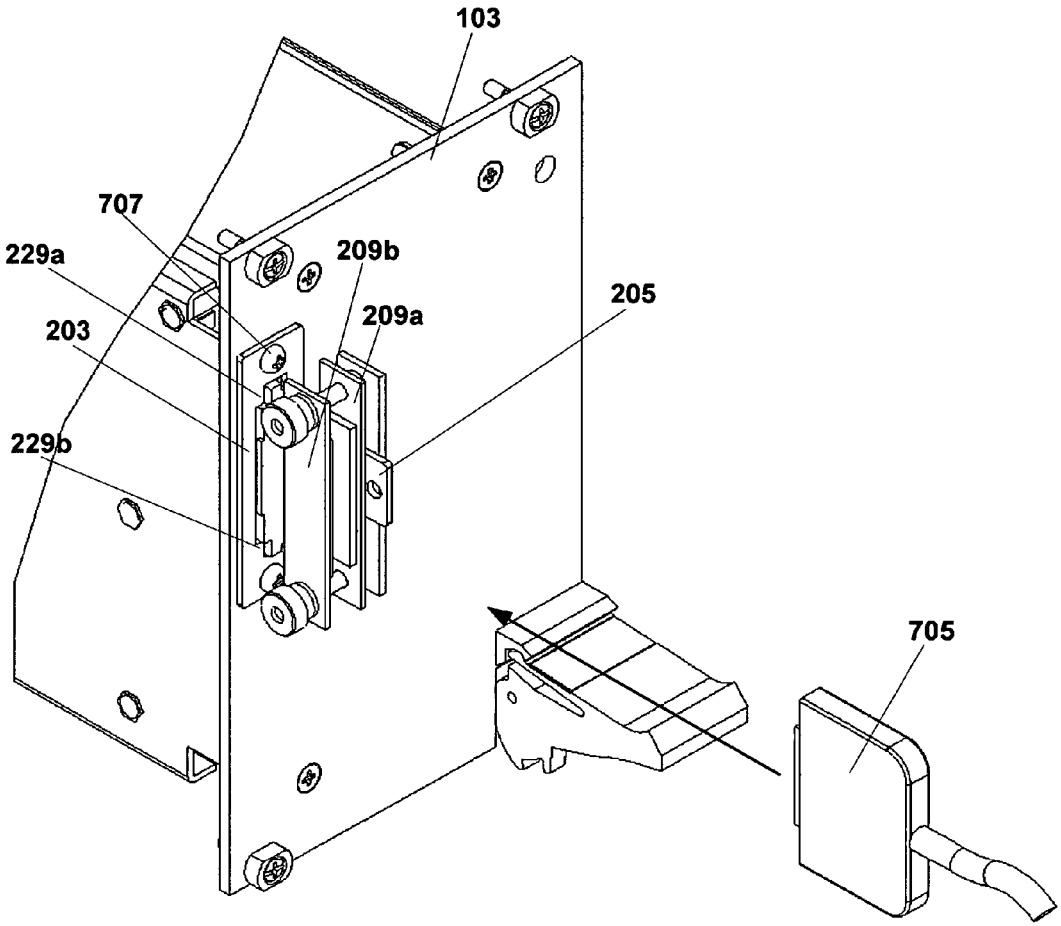

At 603, a base 203 (seen in FIG. 7*b*) may be coupled to the module 103 over the card 701. In some embodiments, the base 203 may include at least one tab 229 that aligns with a notch on the card 701 when the base 203 is coupled to the module 103 over the card 701. The base 203 may secure the card 701 to the module 103.

At 605, a cable 705 may be coupled to a connector on the card 701.

Figure 7C:
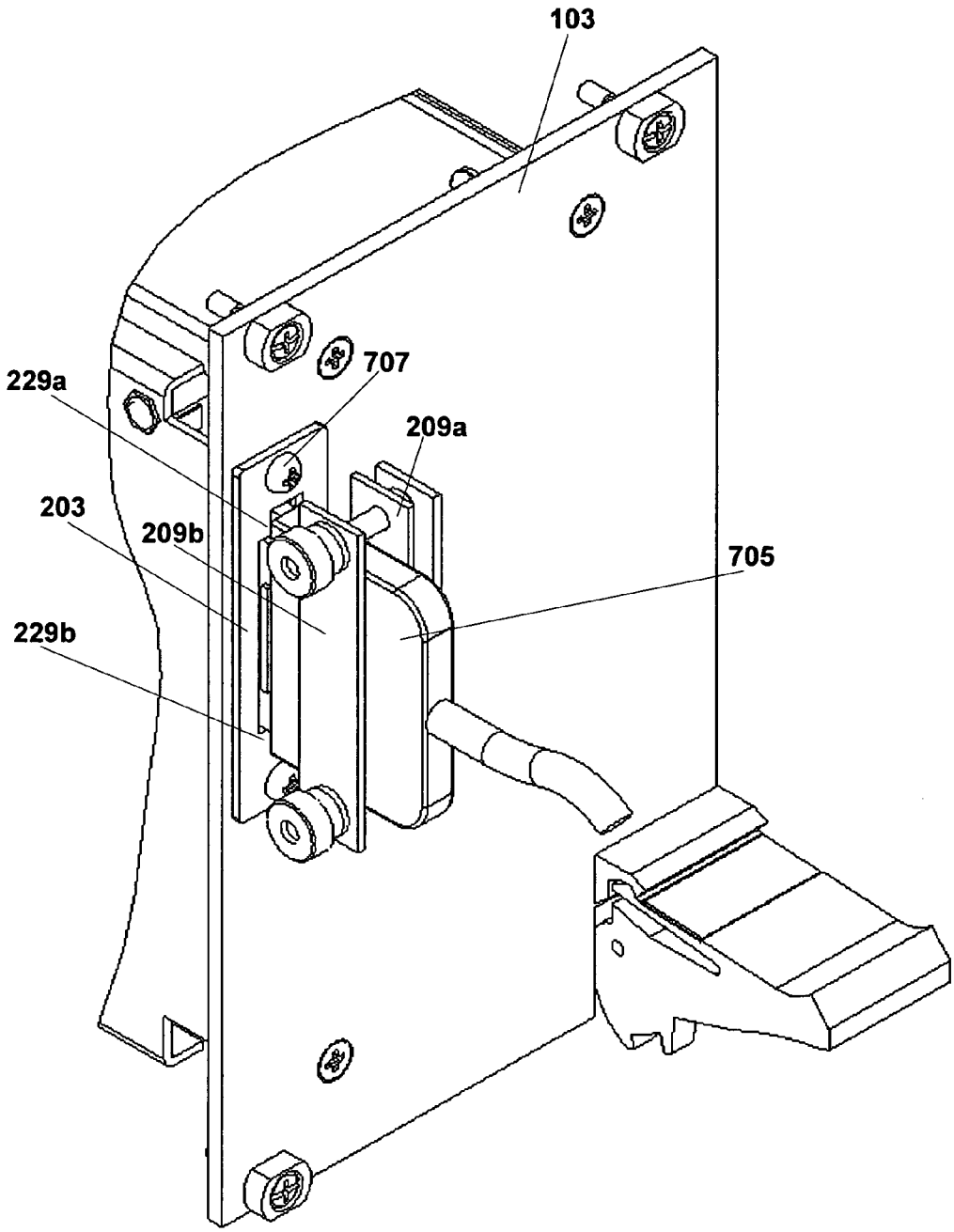

At 607, a cable grip, coupled to the base 203, may be tightened on the cable 705. In some embodiments, a positioning strip 205, coupled to the base 203 and to the cable grip may be adjusted to increase or decrease a distance between the cable grip and the base 203. Adjusting the distance between the cable grip and the base 203 may allow positioning of the cable grip around a main section of a cable 705. In some embodiments, the cable grip may be tightened by adjusting at least one fastener on the cable grip to decrease a distance between two plates 209 (one on each of an opposing side of the cable 705) of the cable grip (seen in FIG. 7*c*).

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. An apparatus, comprising:
a base;
a positioning strip coupled to the base;
a cable grip coupled to the positioning strip;
wherein the cable grip is configured to restrict movement of a cable when the cable is secured in the cable grip;
wherein the cable grip comprises:
a first plate;
a second plate; and
an adjustable fastener coupled to both the first plate and the second plate, wherein the adjustable fastener may be adjusted to decrease or increase a distance between the first plate and the second plate to secure the cable;
wherein the cable grip is adjustable on the positioning strip to increase or decrease a distance between the cable grip and the base.

2. The apparatus of claim 1, further comprising cushioning material coupled to the first plate or the second plate.

3. The apparatus of claim 1, wherein the positioning strip comprises at least one hole, wherein the cable grip may be secured to the positioning strip using at least one of the at least one hole.

4. The apparatus of claim 1, wherein the base is coupled to a module.

5. The apparatus of claim 1, further comprising:
a PXI (Peripheral Component Interconnect (PCI) eXtensions for Instrumentation) module comprising a slot;
an expresscard inserted into the slot on the PXI module, wherein the expresscard has at least one notch; and
wherein the base comprises a tab and is coupled to the PXI module and wherein the tab on the base covers the at least one notch of the expresscard to secure the expresscard to the PXI module.

6. The apparatus of claim 1, wherein the cable grip is configured to restrict movement of the cable when a cable connector of the cable is secured in the cable grip.

7. The apparatus of claim 3, wherein the at least one hole on the positioning strip comprises at least two holes and wherein the cable grip may be secured to the positioning strip using at least two of the at least two holes, and wherein, when the cable grip is secured to the positioning strip using the at least two of the at least two holes, the cable grip does not rotate relative to the positioning strip.

8. The apparatus of claim 3, wherein the at least one hole on the positioning strip comprises at least two holes and wherein the distance between the cable grip and the base may be greater by coupling the cable grip to the positioning strip at a hole of the at least two holes on the positioning strip further away from the base than if the cable grip was coupled to the positioning strip at a hole of the at least two holes on the positioning strip closer to the base.

9. The apparatus of claim 4, wherein the base is coupled to the module through a screw, adhesive, a rivet, or a snap.

10. The apparatus of claim 5, further comprising:
a bracket;
wherein the positioning strip comprises at least one first hole;
wherein the bracket is coupled to the at least one first hole in the positioning strip; and
wherein the cable grip is coupled to the bracket by a fastener.

11. The apparatus of claim 10, wherein the positioning strip further comprises at least one second hole;

wherein the bracket comprises at least one hole; and wherein the bracket further comprises a projection configured to engage the at least one second hole on the positioning strip when the bracket and the positioning strip are secured together using the at least one hole on the bracket and the at least one first hole on the positioning strip.

12. The apparatus of claim 10, wherein the bracket comprises at least one hole; and wherein the positioning strip further comprises a projection configured to engage the at least one hole on the bracket when the bracket and the positioning strip are secured together using the at least one hole on the bracket and the at least one first hole on the positioning strip.

13. The apparatus of claim 10, wherein the base further comprises foam on a side of the base that faces the expresscard when the expresscard is secured in the PXI module by the base.

14. An apparatus, comprising:

a base;

a positioning strip coupled to the base, wherein the positioning strip comprises at least one hole;

a cable grip coupled to the positioning strip, wherein the cable grip comprises:

a first plate; and a second plate;

wherein the cable grip is configured to restrict movement of a cable when the cable is secured in the cable grip; and a bracket, wherein the bracket has at least one hole to align with the at least one hole on the cable grip and the bracket has at least one hole to align with the at least one hole on the positioning strip.

15. The apparatus of claim 14, wherein the at least one hole on the bracket to align with the at least one hole on the cable grip comprises at least two holes;

wherein the at least one hole on the cable grip comprises at least two holes;

wherein the at least two holes on the bracket to align with the at least one hole on the cable grip comprises at least one hole on opposing sides of the bracket to engage corresponding holes of the at least two holes on the cable grip using fasteners.

16. The apparatus of claim 14, wherein the at least one hole on the positioning strip comprises at least one first hole and wherein the positioning strip further comprises at least one second hole;

wherein the at least one hole on the bracket to align with the at least one hole on the positioning strip is configured to align with the at least one first hole on the positioning strip; and wherein the bracket further comprises at least one projection to engage the at least one second hole on the positioning strip;

wherein when the bracket is secured to the positioning strip through the at least one hole on the bracket and the at least one first hole on the positioning strip, the at least one projection on the bracket engages the at least one second hole on the positioning strip to prevent rotation of the bracket relative to the positioning strip.

17. The apparatus of claim 14, wherein the positioning strip further comprises a projection;

wherein the at least one hole on the bracket to align with at least one hole on the positioning strip comprises at least one first hole on the bracket;

wherein the bracket further comprises at least one second hole to engage with the projection on the positioning strip;

wherein when the bracket is secured to the positioning strip through the at least one first hole on the bracket and the at least one hole on the positioning strip, the projection on the positioning strip engages the at least one second hole on the bracket to prevent rotation of the bracket relative to the positioning strip.

18. The apparatus of claim 14, further comprising at least one spacer between the bracket and the cable grip to approximately center the cable grip over the base.

19. The apparatus of claim 14, further comprising:

a PXI (Peripheral Component Interconnect (PCI) eXtensions for Instrumentation) module comprising a slot;

an expresscard inserted into the slot on the PXI module, wherein the expresscard has at least one notch; and wherein the base comprises a tab and is coupled to the PXI module and wherein the tab on the base covers the at least one notch of the expresscard to secure the expresscard to the PXI module.

20. The apparatus of claim 19, wherein the base further comprises foam on a side of the base that faces the expresscard when the expresscard is secured in the PXI module by the base.

21. The apparatus of claim 14, wherein the cable grip is configured to restrict movement of the cable when a cable connector of the cable is secured in the cable grip.

22. An apparatus, comprising:

a base;

a positioning strip coupled to the base;

a cable grip coupled to the positioning strip; wherein the cable grip is configured to restrict movement of a cable when the cable is secured in the cable grip;

wherein the cable grip is adjustable to increase or decrease a grip on the cable when the cable is in the cable grip;

wherein the cable grip is adjustable on the positioning strip to increase or decrease a distance between the cable grip and the base; and wherein the base comprises at least one portion that fits over a notch in a card when the card is secured by the base.

23. The apparatus of claim 22, wherein the cable grip is configured to restrict movement of the cable when a cable connector of the cable is secured in the cable grip.

* * * * *